US005558469A

United States Patent [19]

Hellerman

[11] Patent Number: 5,558,469

[45] Date of Patent: Sep. 24, 1996

[54] ROTATING PILE GUIDE

[76] Inventor: Lance W. Hellerman, 3905 Marlowe, Houston, Tex. 77005

[21] Appl. No.: 241,567

[22] Filed: May 12, 1994

[51] Int. Cl.[6] ..... E02D 13/04

[52] U.S. Cl. ..... 405/232; 405/227

[58] Field of Search ..... 405/227, 228, 405/231, 232

[56] References Cited

U.S. PATENT DOCUMENTS

| | | | |
|---|---|---|---|
| 4,509,883 | 4/1985 | Thibodeaux et al. | 405/232 |
| 4,818,145 | 4/1989 | Carruba | 405/227 X |
| 4,842,446 | 6/1989 | Carruba | 405/227 |
| 4,932,811 | 6/1990 | Folding | 405/227 |
| 4,966,496 | 10/1990 | Stelzer, Jr. | 405/227 |
| 5,051,036 | 9/1991 | Gomez De Rosas et al. | 405/227 |

*Primary Examiner*—Tamara L. Graysay
*Assistant Examiner*—Frederick L. Lagman

[57] ABSTRACT

A method of installing piles for offshore platforms consisting of a rotating clamp attached to the structure through which the pile can slide until driven to a required depth, and then tightened to secure the pile. The pile may be made up and inserted in a vertical position until the pile tip reaches the seabed. The pile is then rotated to its permanent position and driven to a required depth.

3 Claims, 4 Drawing Sheets

SECTION A

SECTION B

SECTION C

ROTATING PILE GUIDE

SUMMARY OF THE INVENTION

The invention presented herein generally concerns the installation of piles used for supporting and pinning offshore bottom supported structures. A means of easily installing piles on offshore platforms is provided by means of a rotating pile guide which allows pile installation at a minimum stress level and a pile clamp which allows quick and easy connection of the pile to the structure.

DESCRIPTION OF DRAWINGS

The following drawings are provided for a better understanding of the invention.

DETAILED DESCRIPTION

The development of small offshore pockets of oil and/or gas is often dependent upon the ability to install light weight, easily installed, cost efficient platforms. The method of installation must be compatible with the overall economical requirements of the light weight type structure.

Some offshore structures use a system in which the pile is placed in a sleeve, the sleeve being inclined at some angle from the vertical. Sections are added to the pile and the pile is slid down through the sleeve until it reaches the sea floor. After the pile is on the sea floor the pile becomes supported by both the pile guide and the sea floor. The pile is then driven to the required depth with as many sections being added as required. As the water depth increases, the amount of pile overhanging the pile guide before the pile touches bottom increases. The efficiency of the system falls off rapidly as the water depth increases. The rotating pile guide significantly improves efficient use of steel and increases the allowable depth range by 1) allowing the amount of steel used to be minimized by optimizing the angle of the piling 2) by allowing the installation of the piling with a minimum of equipment, 3) minimizing the built in or initial stresses in the structure, and 4) by allowing installation of the initial pile sections in a vertical position without undo loading on the pile sleeve. The moment imposed on the pile guide induces stress in the structure which adds to the overall stress of the structure when in service. The problem of installing a batter pile through a fixed sleeve is overcome by allowing the pile to be set in a vertical position and then rotated to the proper angle after the bottom of the pile comes in contact with the sea floor.

Figure 1:
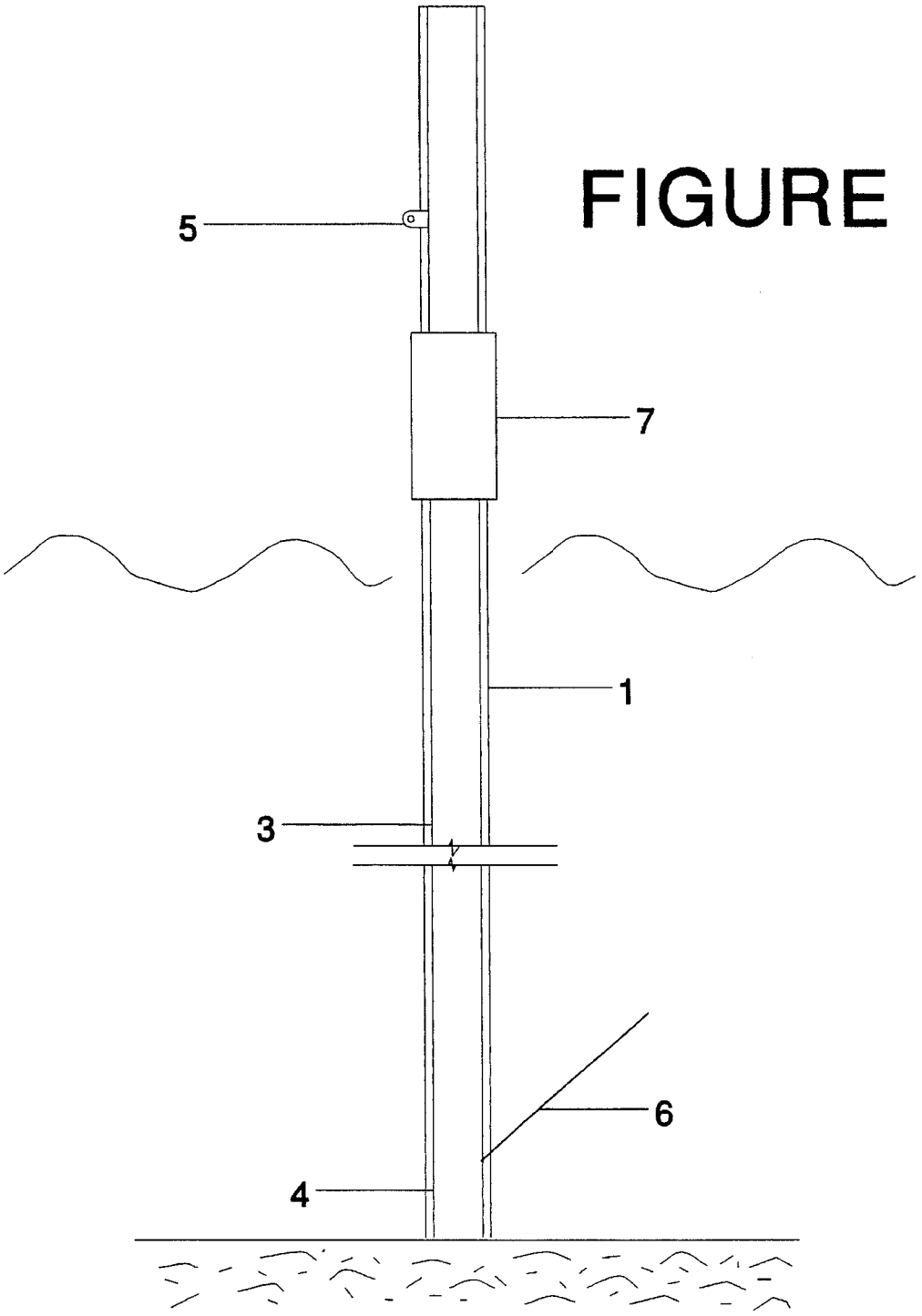
FIG. 1: is an elevation view depicting the initial vertical installation concept for placement of the pile.
Figure 2:
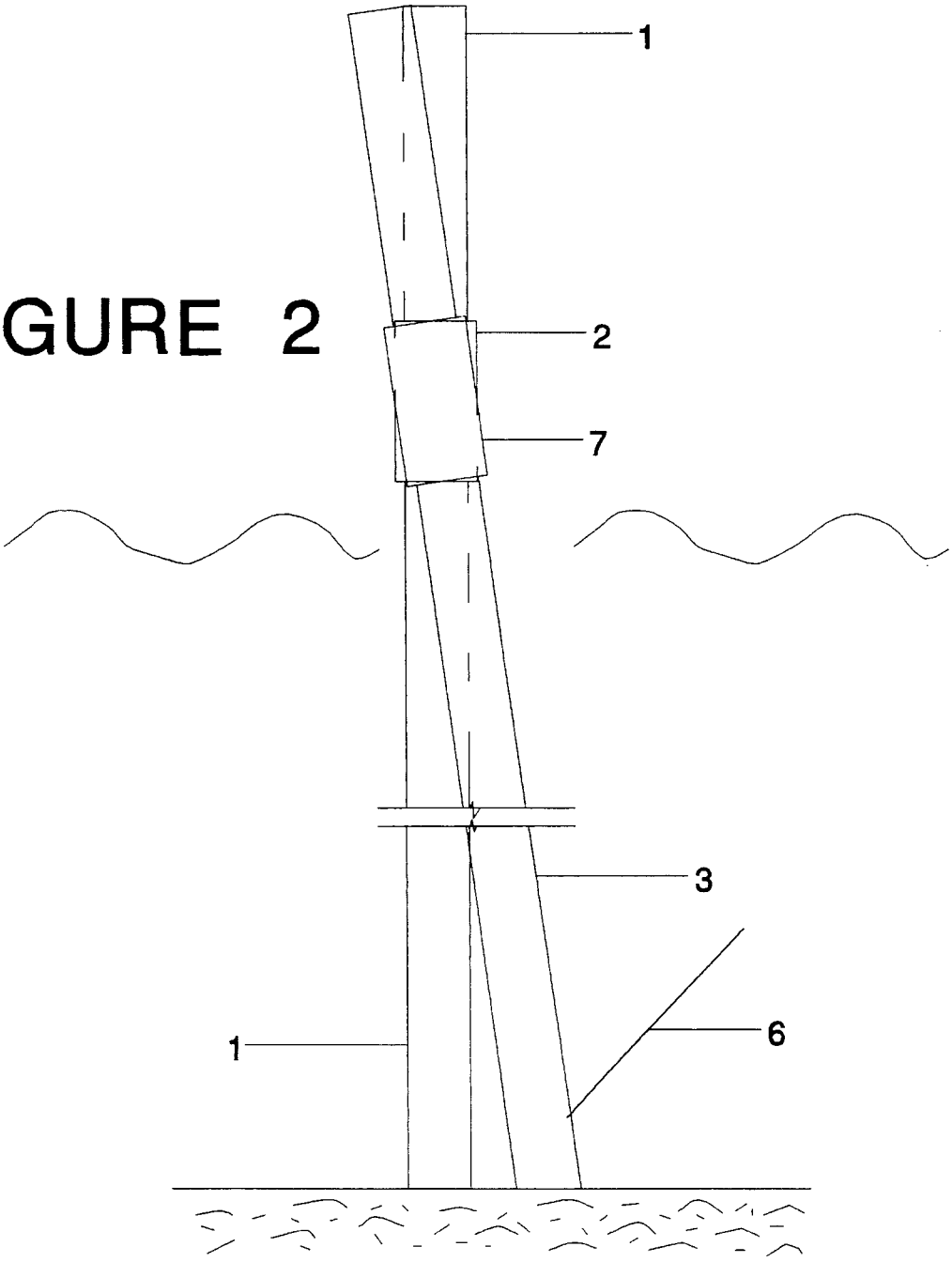
FIG. 2: is an elevation view showing the subsequent rotation of the pile from the vertical.

The general installation procedure is shown in FIG. 1. The main center column (1) is installed first. The pile guide (2) is then attached to the center column. This attachment may be by either bolting or welding as the situation dictates. The rotating pile sleeve (7) would normally be installed already attached to the pile guide but since the rotating pile guide is a separate component it can be installed after the pile guide is attached. A pile (3) is then inserted with the rotating pile sleeve (7) in the vertical position. The pile is lowered (with sections being added as required) until the pile foot (4) reaches the sea floor. With the pile foot at the sea floor, the weight of the pile is held by lifting at a padeye (5) attached just above the pile guide or by means of a pad or clamp above the rotating pile sleeve. A wire (6) is attached to the bottom of the pile. This wire is then attached to a winch, crane, boat, or other suitable pulling device and used to pull the bottom of the pile over until the desired angle of the pile is achieved. The pile is then lowered into the sea floor while maintaining the angle. An alternative procedure would be to attach the padeye below the rotating sleeve and to pull on the top of the pile. With this installation procedure the lifting force is assisting in the rotation. The method used will normally depend upon the equipment available for the installation. The pile is shown in the rotated position in FIG. 2. The wire (6) and the padeye (5) are then removed. The pile is then driven down until the desired penetration is achieved. Because the pile guide rotates, no stress is imposed in the structure due to the action of the installation of the pile. Any number of piles can be installed in this fashion depending upon the nature of the structure and the loading. The structure can consist of one or more members and/or bracing.

Figure 3:
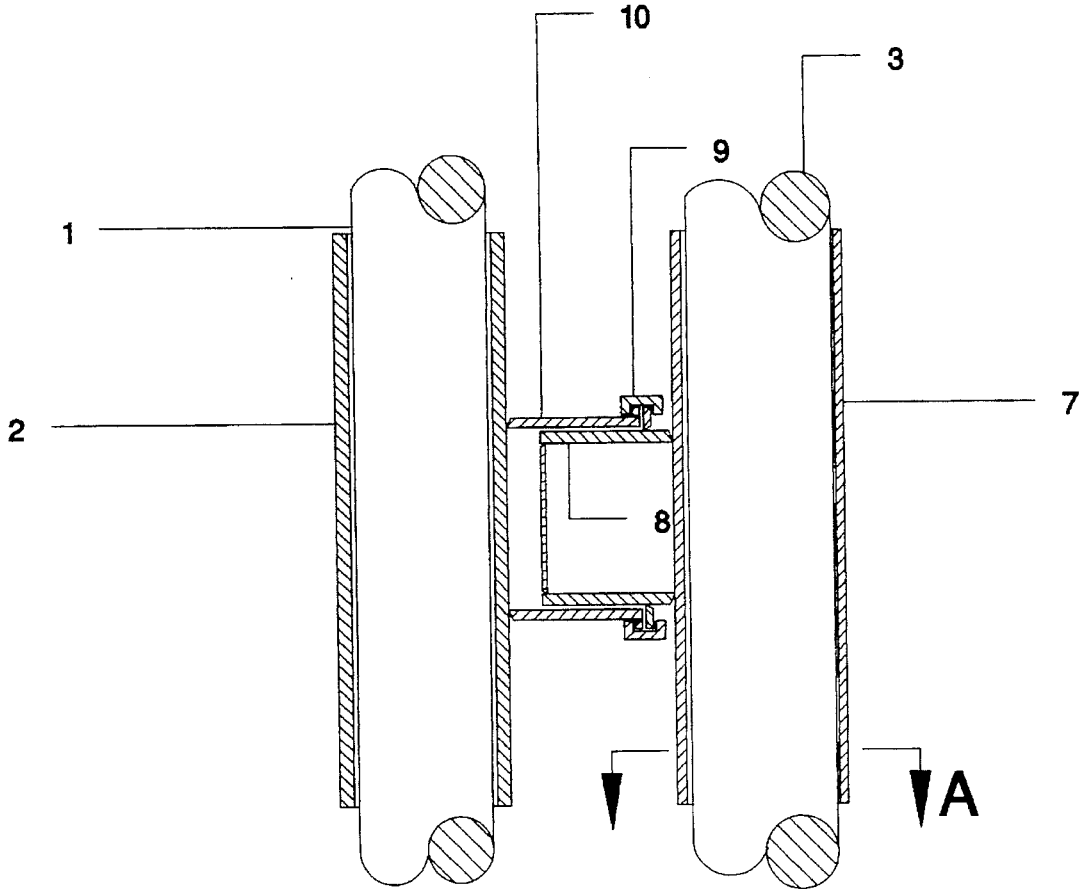
FIG. 3: is a detailed section of the mechanism which allows the pile to rotate from the vertical.

The nature of the rotating pile guide is illustrated in FIG. 3. The rotating mechanism consists of a retaining sleeve (10) which is attached to the structure of the pile guide (2). The retaining sleeve (10) is shown being attached to the pile guide (2), however, in some instances the retaining sleeve may be welded or attached directly to the main column (1). A concentric shaft (8) fits into the retaining sleeve (10) and a retaining ring (9) which holds the shaft in place. The overlapping nature of the sleeve and the shaft allow both moments and forces to be transmitted through the joint.

Figure 4:
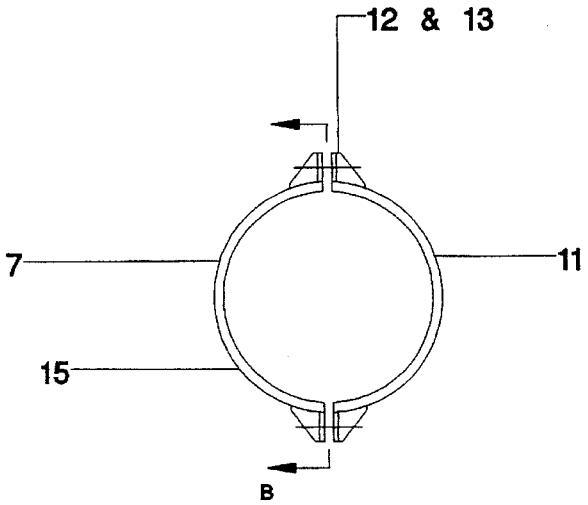
FIG. 4: is a detailed section of the pile guide shell and the shear ribs.
Figure 4:
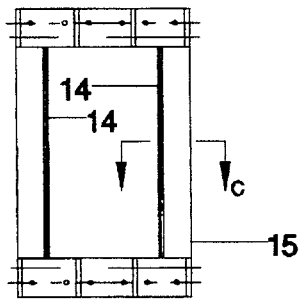
Figure 4:
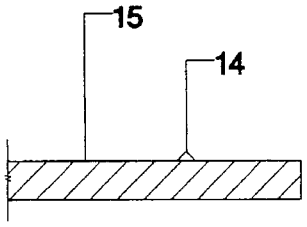

The pile guide consists of a clamp assembly to allow a quick connection of the pile to the structure as shown in FIG. 4. The quick connect feature is important during the installation process in order to minimize the cost and the time required for the installation. The pile guide components consist of an inner shell (15) which is welded to the shaft (8) and a clamp shell (11) which is bolted using bolts (12) and nuts (13) to the inner shell. Pieces ( 11 ) (12) (13) (14) and (15) comprise the rotating pile sleeve (7). Depending upon the situation and the loading the rotating pile guide can be a single piece welded top and bottom to the pile, a split shell with bolted connection, or a half shell welded to the pile. In the last case a clamp shell would be used to temporarily contain the pile until it is driven to depth. Once in place the inner shell would be welded to the pile and the outer shell would be removed. Ribs (14) are welded or machined onto the inside of the inner shell to transfer the axial load from the pile to the guide. These ribs are intended to be installed when the loading on the pile is more than the loading which can be transferred using friction alone. The ribs will physically deform the pile causing a shear rather than a friction connection. The number and spacing of the ribs depends upon the magnitude of the pile loading.

Preferred embodiments of the invention are described in the foregoing and shown in the drawing, but these are merely by way of example. Many other embodiments are conceivable within the scope of the claims.

I claim:

1. A rotating pile guide consisting of a bolted clamp shell being attached at one end to an offshore structure through a joint capable of rotation around an axis perpendicular to longitudinal axis of the clamp shell and fastened by a retaining ring to a standoff from the structure.

2. The rotating pile guide of claim 1, wherein the circular retaining ring has a "U"-shaped cross section having two segments fastened together by bolts.

3. The rotating pile guide of claim 1, wherein the bolted clamp shell is composed of an inner shell and an outer shell, being hinged, and when bolted together, forming a complete circular shell.

* * * * *